United States Patent [19]

Nakamura et al.

[11] 4,070,188

[45] Jan. 24, 1978

[54] ONE BATH TYPE SILVER DYE BLEACHING AND SILVER BLEACHING

[75] Inventors: Takashi Nakamura; Shigeru Watanabe, both of Minami-ashigara, Japan

[73] Assignee: Fuji Photo Film Co., Ltd., Minami-ashigara, Japan

[21] Appl. No.: 699,121

[22] Filed: June 23, 1976

[30] Foreign Application Priority Data

June 23, 1975 Japan ..... 50-77945

[51] Int. Cl.[2] ..... G03C 7/00; G03C 5/32

[52] U.S. Cl. ..... 96/53; 96/60 R; 96/60 BF

[58] Field of Search ..... 96/60 R, 60 BF, 53

[56] References Cited

U.S. PATENT DOCUMENTS

| | | | |
|---|---|---|---|
| 2,304,987 | 12/1942 | Young et al. | 96/53 |
| 2,322,084 | 6/1943 | Young et al. | 96/53 |
| 3,582,322 | 6/1971 | Edens et al. | 96/60 R |
| 3,716,362 | 2/1973 | Meier | 96/53 |
| 3,963,492 | 6/1976 | Marthaler et al. | 96/53 |

*Primary Examiner*—Mary F. Kelley

*Attorney, Agent, or Firm*—Sughrue, Rothwell, Mion, Zinn and Macpeak

[57] ABSTRACT

A one bath type silver dye bleaching and silver bleaching solution which comprises at least a) a compound which forms a salt or a complex with silver, b) at last one acid selected from sulfamic acid, aliphatic and aromatic sulfonic acids, aliphatic and aromatic sulfinic acids, phosphoric acid and sulfuric acid, c) an organic acid having at least one carboxylic group in its molecule and d) a ferric salt (or a complex thereof with the organic acid c), in which case the solution comprises element a), b) and the complex).

12 Claims, No Drawings

ONE BATH TYPE SILVER DYE BLEACHING AND SILVER BLEACHING

BACKGROUND OF THE INVENTION

1. Field of the Invention

The present invention relates to a processing solution for use in a silver dye bleaching process and particularly to a one bath type silver dye bleaching and silver bleaching solution for simultaneously carrying out dye bleaching and silver bleaching.

2. Description of the Prior Art

The silver dye bleaching process which has been known hitherto comprises the following processing steps. Namely, a sensitive material prepared by adding a mono-, bis- or polyazo dye or an azoxy dye to a silver halide emulsion is applied to a support. This is exposed to light, developed using a common black-and-white developing solution and then fixed. It is then processed with a dye bleaching solution, by which the dye is bleached by reduction in proportion to an amount of silver formed in the layer. In this case, a large amount of metal silver remains in the layer. In order to completely rehalogenate the metal silver or to change it into a soluble salt, it is processed with a silver bleaching solution after carrying out the dye bleaching. It is then dipped in a fixing solution such as a hypo solution, whereby the silver is completely removed and a dye image is formed.

The dye bleaching solution used after black-and-white development in the silver dye bleach process, whereby the dye is bleached in proportion to the amount of silver formed, is a strong acid solution containing:

1. an acid: for example, a hydrohalogenic acid, sulfuric acid or sulfamic acid, etc., 2. a compound which reduces the electric potential of silver by forming a salt or a complex with silver; for example, potassium iodide, monoiodoacetic acid or thiourea, etc., 3. a bleaching catalyst (such is not always necessarily added to the dye bleaching solution; it may also be added to the sensitive material); for example, an azine type compound such as quinoxaline or a quinone type compound such as naphthoquinone, etc. The mechanism of dye bleaching is complicated, but it is believed that the acid decomposes the azo bond of the dye by reduction by means of silver as a catalyst.

In prior art silver dye bleaching processes, the sensitive material was processed by the silver bleaching solution after being processed by the dye bleaching solution. In general, there are two kinds of silver bleaching steps. One is for rehalogenating metallic silver using a solution containing, for example, a cupric salt and hydrohalogenic acid, ferricyanide and potassium halife, or an EDTA iron salt, etc., and the other is for changing metallic silver into a soluble silver salt using a solution containing potassium bichromate and acetic acid. In the former case, the rehalogenated material is then fixed by dipping in a hypo solution to change it into a soluble silver salt, whereby complete bleaching is carried out. In the latter case, though the metal silver becames a soluble salt by silver bleaching, it is subjected to fixing by the hypo solution, whereby complete desilvering is carried out. In either case, the dye image should not be harmed.

The dye bleaching and the silver bleaching should each be carried out quantitatively. If the dye bleaching is carried out in areas where metallic silver is not existent or is carried out regardless of the amount of silver, a precise dye image cannot be obtained after the dye bleaching or stain is generated. Further, if the dye bleaching cannot be completely carried out, a dye image cannot be seen precisely and the brightness of the dye image may deteriorate.

As described above, prior art silver dye bleaching processes have the defect that long processing is required since the dye bleaching and the silver bleaching are carried out separately. Accordingly, many attempts have been made in order to carry out dye bleaching and silver bleaching in the same bath. However, the dye bleaching and the silver bleaching are carried out as a competitive reaction. If the silver bleaching proceeds faster than the dye bleaching, there may be the defect that each function negates the other, for example, silver is oxidized (it sometimes becomes soluble) to result in a deterioration of its ability as a catalyst for dye bleaching. This problem in the prior one bath silver dye bleaching solutions has not been sufficiently overcome.

Further, the dye bleaching solution and the silver bleaching solution each have a strong acidity, because of containing hydrohalogenic acid. However, the hydrohalogenic acid used for provide the desired acidity has the defect that it corrodes processing machines or the other instruments used in the dark room and is harmful to human teeth, since it is volatile and has a strong oxidation ability.

SUMMARY OF THE INVENTION

A first object of the present invention is to provide a one bath type silver dye bleaching and silver bleaching solution whereby dye bleaching and silver bleaching can be carried out in the same bath.

A second object of the present invention is to provide an one bath type silver dye bleaching and silver bleaching solution whereby dye bleaching and silver bleaching can be sufficiently carried out in one step.

A third object of the present invention is to provide a one bath type silver dye bleaching and silver bleaching solution wherein mutual interference between the dye bleaching reaction and the silver bleaching reaction can be substantially disregarded.

A fourth object of the present invention is to provide a one bath type silver dye bleaching and silver bleaching solution which neither corrodes instruments in a dark room such as processing equipment nor has a harmful influence upon humans.

A fifth object of the present invention is to provide a one bath type silver dye bleaching and silver bleaching solution whereby packing can be easily carried out as the process reagents can be present in powdered form.

A sixth object of the present invention is to provide a silver dye bleaching photographic process which comprise black-and-white development, dye bleaching, silver bleaching and fixing, wherein dye bleaching and silver bleaching are simultaneously conducted.

These objects of the present invention have been attained by providing a one bath type silver dye bleaching and silver bleaching solution which comprises at least a) a compound which forms a salt or a complex with silver, b) at least one acid selected from sulfamic acid, aliphatic and aromatic sulfonic acids, aliphatic and aromatic sulfinic acids, sulfuric acid and phosphoric acid, and c) an organic acid having at least one carboxylic acid group in its molecule and d) a ferric salt or a complex thereof. Needless to say, mixtures of various compounds from the above groups can be used with equal success, if desired.

DETAILED DESCRIPTION OF PREFERRED EMBODIMENTS

As the compound which forms a salt or a complex with silver used in the present invention, there are water soluble halides, organic or inorganic sulfur compounds, nitrogen containing organic compounds such as urea, cyanides and thiocyanides, etc.

As the water soluble halides, both organic halides and inorganic halides can be used. The organic halides preferably include those with from 1 to 5 carbon atoms in the case of aliphatic halides and in the case of aromatic halides are monocyclic aromatic halides. Most preferred aliphatic halides include monoiodoacetic acid, ethyliodide, butyl iodide, propyl iodide, ethyl chloride, iodoacetamide and the like. Prepferred inorganic halides include alkali metal halides and alkaline earth metal halides. Preferred aromatic halides include iodobenzoic acid. A broad listing of useful water soluble halides includes.

As the organic sulfur compounds, there are thiourea, thiourea derivatives and mercapto compounds, etc. As the thiourea derivatives, there are compounds represented by the following formula (I).

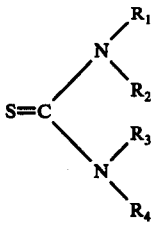

(I)

wherein $R_1$, $R_2$, $R_3$ and $R_4$ represent each a hydrogen, an aliphatic group, an aryl group, an acyl group or an amino group. While the above groups are not unduly limited, preferred aliphatic groups comprise from 1 to 4 carbon atoms , a preferred aryl group is phenyl, and preferred acyl groups have from 1 to 3 carbon atoms.

Examples thereof include 1,3-dimethyl thiourea, 1,3-diethyl thiourea, tetramethyl thiourea, allyl thiourea, 1,1-diphenyl thiourea, thiosemicarbazide, 4-phenyl thiosemicarbazide, 1-phenyl thiosemicarbazide, 1,4-diphenylthiosemicarbazide, 1,5-diphenyl thiosemicarbazide, etc.

Examples of the mercapto compounds include thioglycolic acid and thiomalic acid, etc. Preferred mercapto compounds are aliphatic mercapto compounds.

Examples of the inorganic sulfur compounds include both alkali metal and alkaline earth metal salts of sulfur, for example, sodium sulfide, calcium polysulfide, etc.

Examples of the nitrogen containing compounds include cystein, guanidine and aminoguanidine, etc. Preferred nitrogen containing compounds comprise from 1 to 5 carbon atoms in combination with nitrogen.

Examples of the cyanides include the alkaline earth metal salts thereof such as potassium cyanide, etc., and examples of the thiocyanides include the alkaline earth metal salt thereof such as potassium thiocyanide, etc.

Among the above described compounds which form a salt or a complex with silver, particularly preferred examples used in the invention include potassium iodide, sodium iodide, potassium bromide, sodium bromide, monoiodoacetic acid, thiourea, 1,3-dimethylthiourea, ethylenethiourea and tetramethylthiourea, etc.

In the present invention, one or more acids selected from sulfamic acid, aliphatic and aromatic sulfonic acids, aliphatic and aromatic sulfinic acids, sulfuric acid and phosphoric acid are used instead of volatile acids having a high oxidizing property. As the aliphatic or aromatic sulfonic acids preferably used, there are those wherein one or two sulfonic acid groups are linked to a lower alkyl group having 1 to 5 carbon atoms or to a phenyl group which is not substituted or substituted by one or two lower alkyl groups having 1 to 5 carbon atoms and/or amino groups. Examples thereof include methyl sulfonic acid, ethyl sulfonic acid, benzene sulfonic acid, benzene disulfonic acid, p-toluene sulfonic acid and p-aminobenzene sulfonic acid, etc. As the aliphatic and aromatic sulfinic acids preferably used, there are those wherein one or two sulfinic acid groups are linked to a lower alkyl groups having 1 to 5 carbon atoms or to a phenyl group which is not substituted or is substituted by one or two lower alkyl groups having 1 to 5 carbon atoms and/or amino groups. Examples thereof include methyl sulfinic acid, ethyl sulfinic acid, benzene sulfinic acid and toluene sulfinic acid, etc.

Since these acids are involatile or substantially involatile and have no or substantially no oxidizing properties, they hardly corrode processing machines, instruments used in the dark room and human teeth.

As the organic acids having at least one carboxyl group in the molecule used in the present invention, there are aliphatic and aromatic carboxylic acids and aminopolycarboxylic acids. Preferred carboxylic acids have no more than 8 carboxyl groups in the molecule thereof, and most preferred carboxylic acids have 1–4 carboxyl groups in the molecule thereof.

As the aliphatic carboxylic acids preferably used, there are formic acid and straight or branched alkanes or alkenes having 1 to 18 carbon atoms substituted by one or more carboxyl groups (which may further comprise a mercapto or hydroxyl group). Examples of such acids include acetic acid, propionic acid, butyric acid, valeric acid, isovaleric acid, lauric acid, stearic acid, acrylic acid, methacrylic acid, isocrotonic acid, oleic acid, oxalic acid, malonic acid, succinic acid, glutaric acid, adipic acid, suberic acid, azelaic acid, sebacic acid, maleic acid, fumaric acid, citraconic acid, mesaconic acid, 2,3,5-hexanetricarboxylic acid, 2-(3-carboxypropyl)-1,1,5,6-heptanetetracarboxylic acid, α-mercaptopropionic acid, mercaptosuccinic acid, glycolic acid, glyceric acid, tartaric acid, tropic acid, etc.

As the aromatic carboxylic acids preferably used, there are those wherein one or more carboxyl groups are linked to a benzene ring or a naphthalene ring (which may have one or more lower alkyl, alkoxy or hydroxy groups, preferably no more than 5 of such substituents; most preferred alkyl and alkoxy groups comprise from 1 to 3 carbon atoms) directly or through a lower alkylene group having 1 to 3 carbon atoms. Examples of such acids include benzoic acid, phthalic acid, isophthalic acid, naphthoic acid, p-methoxybenzoic acid, hydratropic acid, salicylic acid, etc. Preferred carboxylic acids have no more than 8 carboxyl groups in the molecule thereof, and most preferred carboxylic acids have 1–4 carboxyl groups in the molecule thereof.

As the aminopolycarboxylic acids, there are compounds having 1 to 3 amino groups and 2 to 8 carboxylic acid groups. Preferably, the aminopolycarboxylic acid comprises from 1 to 15 carbon atoms exclusive of the carbon atoms in said carboxylic acid group(s). Examples of such acids include nitrilotriacetic acid, ethylenediaminetetraacetic acid, diethylenetriaminepentaacetic acid, ethylene glycol bisaminoethyl ether tetraacetic acid, diaminopropanol tetraacetic acid, N-(2-hydroxyethyl)-ethylenediaminetriacetic acid, ethyliminodipropionic acid, N-(carboxymethyl-N'-2-hydroxyethyl-N,N'-ethyleneglycine, orthodiamine cyclohexanetetraacetic acid, etc.

Among the above described organic acids, di- or polybasic acids may be used as in the form of an acid anhydride in the one bath silver dye bleaching solution of the present invention.

Particularly preferred organic acids used for the present invention, from the viewpoint of water solubility and their a beneficial or non-harmful effect on photographic properties, are citric acid, succinic acid, acetic acid, acrylic acid, propionic acid, butyric acid, maleic acid and ethylenediaminetetraacetic acid, etc.

In the present invention, silver bleaching is performed by changing silver into a soluble salt. Ferric salts are compounds used for such a purpose. Examples of ferric salts used in the present invention preferably include the halogen ferric salts and other ferric salts such as ferric chloride, ferric nitrate, ferric citrate, ferric acetate, ferric oxalate, ferric sulfate, ferric bromide, ferric bichromate, ferric formate, ferric naphthenate and ferric phosphate, etc.

In the present invention, the above described organic acid having at least one carboxyl group in the molecule and the above described ferric salt may be added as a separate compounds or in the form of a complex thereof. Examples of the complex include ferric ethylenediaminetetraacetate, ferric ethylenedinitrilotetraacetate, ferric propylenediaminetetraacetate, ferric ethylenetriamine pentaacetate, ferric ethylenedinitrilo-(β-oxyethyl)triacetate, etc.

The amount of the compound which forms a salt or a complex with silver is in a range of about 5 to about 150 g per liter. A particularly preferred amount is in a range of 10 to 80 g per liter. The minimum amount depends upon the bond strength between the compound and silver. However, if the amount is too small, it is not possible to lower the oxidation-reduction potential of silver (about 0.8V) to lower than the oxidation-reduction potential of the azo dye existent in the sensitive material (about 0.3 to 0.4V). Usually, the azo dye is present in an amount of from about 0.3 to about 3 wt.% of the wet emulsion.

If the amount exceeds the upper limit, there may occur the problem that it does not dissolve completely.

The amount of at least one acid selected from sulfamic acid, aliphatic and aromatic sulfonic acids, aliphatic and aromatic sulfinic acids, sulfuric acid and phosphoric acid is the molar number of the acid group(s) which gives a strong acidity, that is, in a range of about 0.03 to about 3 mols per liter. A particularly preferred amount is in a range of 0.07 to 1 mol. If the amount be too small, it is not possible to decrease the pH of the processing solution to below 1.5. If the pH is not below 1.5, it is not possible to bleach the azo dye in the emulsion layer by reduction in the presence of silver as the catalyst. On the contrary, if the amount of the acid is too large, there may be the problem that the properties of the emulsion layer are injured or the bleachable activity of the dye deteriorates.

An amount of the organic acid having at least one carboxyl group in the molecule is in the range of 0.5 to 3 mols per mol of the ferric salt. The amount of the ferric salt is in the range of 0.01 to 1 mol per liter. If the amount is smaller than the above range, a sufficient effect can not be obtained and the preservability and stability of the processing solution are not good. If it is larger than the above described range, the ferric salt cannot be completely dissolved which leads to an insoluble material, whereby development troubles easily arise.

The one bath type silver dye bleaching and silver bleaching solution of the present invention may contain a dye bleaching catalyst as a dye bleaching accelerating agent. Many dye bleaching catalysts are known. It is most preferred that the dye bleaching accelerating catalyst be used in an amount of from about 0.3 to about 3 g/liter. Examples thereof include azines such as pyrazine, quinoxaline, phenazine or naphthazine and quinones such as naphthoquinone or anthraquinone, etc., as described in U.S. Pat. No. 2,270,118, diphenylmethane, triphenylmethane and derivatives thereof as described in U.S. Pat. No. 2,410,025, N-substituted isoalloxazines and derivatives thereof as described in U.S. Pat. No. 2,541,884, indophenazine and derivatives thereof as described in U.S. Pat. No. 2,627,461, furoquinoxaline, thienoxaline and derivatives thereof as described in U.S. Pat. No. 2,699,517, lumazin, alloxazine and derivatives thereof as described in British Patent No. 657,374, cinnoline and derivatives thereof as described in British Patent No. 711,247, compounds having an imidazo(4,5-b)pyrazine skeleton or an imidazo(4,5-b)pyrazine-3-ium skeleton as described in Japanese Patent Application 5178/75, and benzimidazole-4,7-diones, naphthimidazole-4,9-diones and 5,8-dioxo-benzopyrazines as described in Japanese Patent Application 6177/75, which may be added alone or as a mixture of two or more thereof.

Many additives can be optionally added to the one bath type silver dye bleaching and silver bleaching solution, e.g., surface active agents for accelerating permeation of chemicals into the emulsion layer or for uniformly permeating the chemicals, weak reducing agents for improving stability of the solution or for accelerating dye bleaching, weak oxidizing agents for softening the gradation of the photographic characteristic curve, and various salts, solvents and amines.

The amounts of these additives added vary more or less according to properties of the sensitive material used or the composition of the one bath type silver dye bleaching and silver bleaching solution. Generally, they can each be added in a, range of about 0.1 to about 50 g and preferably 0.3 to 30 g per liter of the solution.

As the surface active agents, there are anionic surface active agents such as carboxylic acid type, sulfonic acid type, sulfuric acid ester type or phosphoric acid ester type surface active agents, etc., cationic surface active agents such as heterocyclic amine base type, ammonium salt type, sulfonium salt type or phosphonium salt type surface active agents, etc., and nonionic surface active agents and ampholytic surface active agents such as polyethylene glycol type, poly-(oxyethylene- oxypropylene) type, polyoxyethylene-ester type, polyoxyethylene- alcohol ether type, polyoxyethylene-diether type, polyoxyethylene- amine type, polyoxyethylene-amide type, sorbitan ester type, polyglycerol type or sucrose type agents, etc.

As the weak reducing agents, there are phenol, aminophenol and substituted compounds thereof such as paraaminophenol-2-sodium sulfonic acid, paranitrophenol, and the like, sugar, ascorbic acid and mercapto compounds. Examples of the mercapto compounds include 2-mercaptobenzothiazole, 2-mercaptobenzimidazole, 5-mercapto-3,4-thiadiazole, 1-phenyl-5-mercaptotetrazole, thiomalic acid and 2-mercaptopropane sulfonic acid, etc.

As the weak oxidizing agent, there are Tartrazine, Orange G, 1-nitroanthraquinone-8-sulfonic acid, p-nitrodiethylaniline, nitrobenzenesulfonic acid, ammonium vanadate and ammonium ferric sulfate, etc.

As the salts, there are neutral salts of a strong acid and a strong alkali, such as sodium chloride or potassium chloride, etc. and other salts such as calcium carbonate and magnesium sulfate, etc.

As the solvents, there are methanol, ethanol, methyl ethyl ketone, ethyl cellosolve, methyl cellosolve, propanol and acetone, etc.

As the amines, there are aliphatic amines such as triethylamine or diethylamine, etc.

The silver halide emulsions of the sensitive material to which the present invention is applied are produced by mixing a solution of a water soluble silver salt (for example, silver nitrate) with a solution of a water soluble halide (for example, potassium bromide) in the presence of a solution of a conventional water soluble high molecular weight material such as gelatin. As the silver halide, silver bromide, silver bromochloride, silver iodobromide or silver iodobromochloride can be used.

The photographic emulsions, which are described in "The Theory of Photographic Process" written by Mees, published by MacMillan Co. and "Chimie Photographique" written by Glafkides, published by Paul Montel Co. (1957), can be produced by various known processes such as an ammonia process, a neutral process or an acid process, etc.

After the formation of the silver halide particles, the emulsion is generally washed with water in order to remove by-produced water soluble salts (for example, potassium nitrate in the case that silver bromide was produced using silver nitrate and potassium bromide) from the system. The emulsion is then generally chemically aged in the presence of chemical sensitizers such as sodium thiosulfate, N,N,N'-trimethylthiourea, a thiocyanate complex salt of monovalent gold, a thiosulfate complex salt, stannous chloride, triethylenetetramine or hexamethylenetetramine, etc.

The silver halide particles used in the present invention are thus seen to be conventional, and other characteristics thereof are not overly important.

The silver halide emulsions may be spectrally sensitized using methine dyes such as cyanine dyes, merocyanine dyes, hemicyanine dyes or stylyl dyes, etc., if desired.

In the resultant silver halide emulsions, dyes, for example, those described hereinafter, are dispersed.

As yellow dyes, there are azo dyes such as Direct Fast Yellow GC (C.I. 29000) or Chrysophenine GC (CI 24895), etc., benzoquinone type dyes such as Indogo Golden Yellow IGK (CI 59101), Indigozol Yellow 2GB (CI 61726), Algosol yellow GCA-CF (CI 67301), Indanthrene Yellow GF (CI 68420), Mikethrene Yellow GC (CI 67300) or Indanthrene Yellow 4GK (CI 68405), etc., anthraquinone type and polycyclic type soluble vat dyes and other vat dyes. As magenta dyes, there are azo dyes such as Sumilight Supra Rubinol B (CI 29225) or Benzobrilliant Geranine B (CI 15080), etc., indigoid dyes such as Indigosol Brilliant Pink IR (CI 73361), Indigosol Violet 15R (CI 59321), Indigosol Red Violet IRRL (CI 59316), Indanthrene Red Violet RRK (CI 67895) or Mikethrene Brilliant Violet BBK (CI 6335), etc., soluble vat dyes such as benzoquinone type or anthraquinone type heteropolycyclic compounds, etc., and other vat dyes. As cyan dyes, there are azo dyes such as Direct Sky Blue 6B (CI 24410), Direct Brilliant Blue 2B (CI 22610) or Sumi-light Supra Blue G (CI 34200), etc., phthalocyanine dyes such as Sumilight Supra Turquoise Blue G (CI 74180) or Mikethrene Brilliant Blue 4G (CI 74140), etc., and dyes such as Indanthrene Turquoise Blue 5G (CI 69845), Indanthrene Blue GCD (CI 73066), Indigosol 04G (CI 73046) or Anthrazol Green IB (CI 59826), etc.

Further, if desired, a color sensitive material for a silver dye bleach process can be produced by adding the above described dye bleaching catalyst to the material.

The produced sensitive material is image-wise exposed to light and developed by black-and-white development. The exposure conditions are not overly important; they are conventional and will be easily ascertainable by one skilled in the art. In order to carry out the black-white development, various known developing solutions can be used (for example, Kodak D-76 or D-72, etc.).

Useful black-and-white developers can easily be selected by one skilled in the art, and the exact black-and-white developer selected is not overly important.

Typically, such will comprise a hydroquinone such as hydroquinone in an amount of from about 1 g to about 15 g/liter in combination with a secondary developer such as, for example, 1-phenyl-3-pyrazolidone or m-methylaminophenol, etc., in an amount of from about 0.1 to about 6 g/liter, sodium sulfite in an amount of from about 20 to about 60 g/liter, and an alkali agent such as sodium carbonate, sodium hydroxide, etc., to provide the developer with a pH of 9–11, Commonly, other additives such as anti-fogging agents are added in an amount of from about 0.01 to 0.4 g/liter, for example, potassium bromide, potassium iodide, benzotriazole, etc.

After carried out the development, the sensitive material is dipped in a fixing solution containing thiourea, a thiourea derivative (for example, ethylene thiourea or dimethylthiourea, etc.), ammonium thiosulfate and/or hypo as main ingredients to remove excess silver halide. This fixing step is only carried out if necessary, and may be omitted. The fixing is essentially conventional and is conveniently effected with a solution containing ammonium thiosulfate in an amount of from about 90 to about 200 g/liter and sodium sulfite in an amount of from about 10 to about 30 g/liter.

The sensitive material is then dipped in the one bath type silver dye bleaching and silver bleaching solution of the present invention to remove residual silver halide, whereby a dye image which is positive to the original is obtained.

The one bath type silver dye bleaching and silver bleaching solution of the present invention does not cause the problem that the function of the dye bleaching agent and the silver bleaching agent cancel each other. Though the reason therefor is not clear, it is believed that the organic acid of component c) interacts with the ferric salt to soften the oxidation reaction of the ferric salt with silver, whereby the dye bleaching arises first by means of silver as the catalyst and the silver is then removed by oxidation.

The one bath type silver dye bleaching and silver bleaching solution of the present invention does not have a harmful influence upon processing machines and the other instruments used in the dark room nor upon humans, and, thus, there is no danger of generating environmental pollution because acids easily volatile and having a strong oxidizing property are not used.

According to the one bath type silver dye bleaching and silver bleaching solution of the present invention, dye bleaching arises prior to silver bleaching, and then it is always possible to obtain a dye image faithful to the original, since the silver bleaching can be carried out completely without injuring the dyes.

Since the one bath type silver dye bleaching and silver bleaching solution of the present invention may be supplied in a powder state if the acid described in b) and the organic acid described in c) are suitably selected, packing thereof can be simply carried out and the weight thereof is light as compared with prior art liquid agents which required a container such as a glass bottle. Accordingly, there are many merits in transporting it.

It will be appreciated by one skilled in the art that while the basic process of the present invention includes the essential steps of black-and-white development, dye-bleaching and silver bleaching (these two steps being combined into one) and fixing, other steps can be added, if desired.

Though not to be construed as limitative, certain highly preferred compositions exist for use in accordance with the present invention when it is practiced on a commercial scale. For example, the one bath type silver dye bleaching and silver bleaching solution contains at least one compound which forms a salt or complex with silver as earlier described in an amount of from about 10 to about 120 g/liter, at least one acid selected from the earlier described group in an amount of from about 10 to about 120 g/liter, at least one organic acid as earlier described in an amount of from about 2 to about 60 g/liter and at least one ferric salt as earlier described in an amount of from about 2 to about 60 g/liter*; the process is conveniently practiced at 20° to 40° C for a period of from about 2 to about 10 minutes and at atmospheric pressure.

* When a complex is used, the amount can vary from about 4 to about 120 g/liter.

In the following, the present invention will be illustrated in greater detail by reference to several examples.

EXAMPLE 1

Onto a cellulose triacetate support provided with a subbing layer, a silver bromochloride emulsion (Br content: 6 mol%) containing the following cyan dye in an amount of 1.2 wt.% of the dye based on the wet emulsion was applied and a protective layer was then provided thereover to produce a sensitive material. The thickness in a dried state of the emulsion layer was 4 μ and that of the protective layer was 1 μ. An amount of silver applied was 6 mg silver/dm$^2$.

Cyan dye

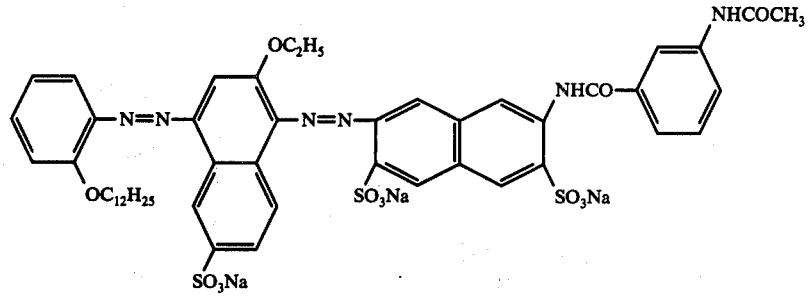

After exposure to light, the sensitive material was developed at 24° C for 7 minutes using a black-and-white developing solution having the following composition and then processed at 24° C for 1 minute using a rapid fixing solution containing ammonium thiosulfate as a main ingredient.

| Composition of black-white developing solution | |
|---|---|
| Anhydrous sodium sulfite | 48 g |
| Hydroquinone | 1.8 g |
| 1-Phenyl-3-pyrazolidone | 0.24 g |
| Sodium metaborate . 4$H_2O$ | 7 g |
| Boric acid | 0.42 g |
| Potassium bromide | 0.2 g |
| Benzotriazole | 0.03 g |
| Water to make | 1 liter |
| Composition of the fixing solution | |
| Ammonium thiosulfate | 200 g/liter |
| Sodium sulfite (anhydride) | 60 g/liter |

Thereafter, it was processed at 24° C for 4 minutes using a one bath type silver dye bleaching and silver bleaching solution having the following composition.

| Composition of one bath type silver dye bleaching and silver bleaching solution | |
|---|---|
| Sulfamic acid ($H_2NSO_3H$) | 100 g |
| Dimethylquinoxaline | 50 mg |
| Potassium iodide | 10 g |
| Ferric nitrate | 12 g |
| Tartaric acid | 25 g |
| Sodium N-methyl-β-(heptadecanoyl-amino)ethane sulfonate | 1.5 cc (6%) |
| Water to make | 1 liter |

It was then processed using a rapid fixing solution and washed with water, whereby the silver image was completely removed and a dye image was left.

Thus a positive cyan dye image which was faithful to the positive image of the original was obtained.

EXAMPLE 2

After carrying out the black-and-white development and fixing in the same manner as in Example 1, the sensitive material was processed at 24° C for 4 minutes using a one bath type silver dye bleaching and silver bleaching solution having the following composition. It was then processed in the same manner as in Example 1. Thus, a positive cyan dye image which was faithful to the positive image of the original was obtained.

| | |
|---|---|
| Concentrated sulfuric acid | 50 cc |

-continued

| | |
|---|---|
| (96% wt. % sulfuric acid) | |
| Thiourea | 80 g |
| Hydroquinone | 20 g |
| Citric acid | 20 g |
| Ferric chloride | 20 g |
| Water to make | 1000 cc |

EXAMPLE 3

After carried out black-and-white development and fixing in the same manner as in Example 1, the sensitive material was processed at 23° C for 4 minutes using a one bath type silver dye bleaching and silver bleaching solution having the following composition.

| | |
|---|---|
| Sulfamic acid | 60 g |
| Potassium iodide | 25 g |
| Sodium diethylenetriaminopentaacetate | 7 g |
| Ferric chloride hexahydrate | 6 g |
| Phenazine | 100 mg |
| Water to make | 1 liter |

Results similar to Example 1 were obtained.

EXAMPLE 4

To a polyethylene coated paper sheet, a silver bromide emulsion containing a cyan dye in an amount of 0.9 wt% based on the wet emulsion represented by following formula, which was red-sensitized by a thiacarbocyanine dye; anhydro-3,3'-di(β-carboxyethyl)-5,5'dichloro-9-ethyl-thiacarbocyaninehydroxide, in an amount of $9 \times 10^{-4}$ g mol/g mol of silver halide, was applied. A gelatin intermediate layer was applied to the resultant emulsion layer.

Cyan Dye

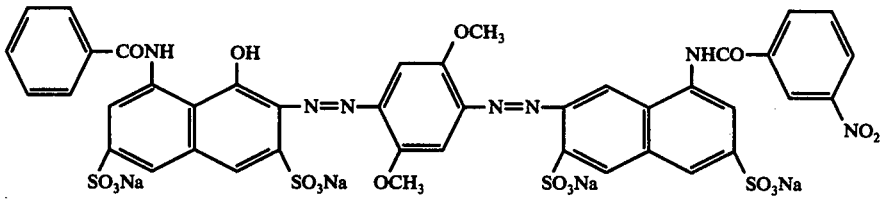

To the resultant gelatin layer, a silver bromochloride emulsion containing a magenta dye in an amount of 1.1% based on the wet emulsion represented by the following formula, which was green-sensitized by oxacarbocyanine dye; anhydro-5,5'-diphenyl-3,3'-di(γ-surphopropyl)-9-ethyl-oxacarbocyanine-hydrooxide, in an amount of $1.2 \times 10^{-3}$ g moo/g mol of silver halide, was applied. A gelatin intermediate layer was then applied onto the resultant emulsion layer.

Magenta Dye

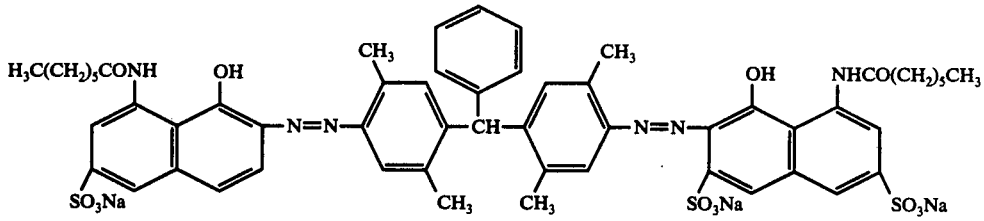

Thereafter, a blue-sensitized silver bromochloride emulsion containing a yellow dye in an amount of 0.9 wt% based on the wet emulsion(represented by the following formula) was applied to the gelatin layer.

A gelatin protective layer was then applied to the resultant emulsion layer.

Yellow Dye

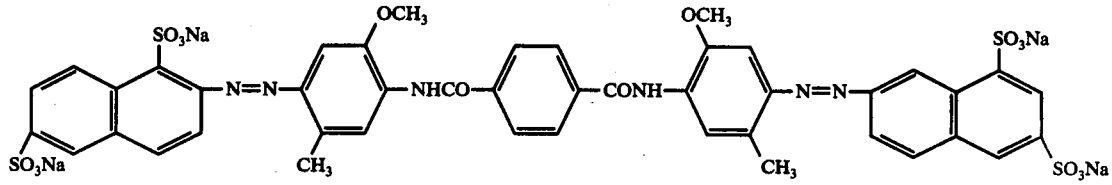

Each layer after application had the following thickness; the gelatin protective layer: about 1 μ, the blue-sensitive layer: about 4 μ, the gelatin intermediate layer: about 3 μ, the green-sensitive layer: about 3.5 μ, the gelatin intermediate layer: about 2 μ, and the red-sensitive layer: about 3.5 μ. The total amount of silver in the layers was 19 mg silver/dm² as follows: the blue-sensitive layer — 7.5 mg silver/dm²; the green-sensitive layer — 6.2 mg silver/dm²; and the red-sensitive layer — 6.3 mg silver/dm².

The blue-sensitive layer comprised silver bromochloride (6 mol % bromine) of an average particle size of 0.3 μ and had an $AgNO_3$/gelatin wt. ratio of 0.9; the green-sensitive layer comprised silver bromochloride (chlorine: 9 mol%) of a size of 0.4 μ with an $AgNO_3$/gelatin weight ratio of 1.1, and the red-sensitive layer was pure silver bromide having an average particle size of 0.4 μ with an $AgNO_3$/gelatin weight ratio of 1.0.

After exposure to light, the sensitive material was processed in the same manner as in Example 1 except that a one bath type silver dye bleaching and silver bleaching solution having the following composition was used, whereby a positive dye image was obtained.

This positive dye image was faithful to the transparent positive image of the original.

| | | |
|---|---|---|
| Sulfamic acid | 60 g | (Processing Condition: 35° C; 4 minutes) |
| Potassium iodide | 25 g | |
| Phenazine | 250 mg | |
| EDTA Fe . $NH_4$ . $H_2O$* | 10 g | |
| Water | 1 liter | |

*Ethylenediaminetetraacetic acid monoammonium ferricsalt monohydrate.

EXAMPLE 5

After carrying out black-and-white development and fixing in the same manner as in Example 4, the sensitive material was processed at 35° C for 3 minutes using a one bath type silver dye bleaching and silver bleaching solution having the following composition.

| | |
|---|---|
| p-Toluenesulfonic acid | 23 g |
| 2-Amino-3-hydroxyphenazine | 18 mg |
| Potassium iodide | 20 g |
| Glacial acetic acid | 7 cc |
| Ferric Formate | 18 g |
| Water to make | 1000 cc |

Results similar to Example 4 were obtained. While the invention has been described in detail and with reference to specific embodiments thereof, it will be apparent to one skilled in the art that various changes and modifications can be made therein without departing from the spirit and scope thereof.

What is claimed is:

1. In a positive-positive silver dye bleaching process which comprises the steps of a black-and-white development, a dye bleaching, a silver bleaching and a fixing, the improvement which comprises the combination of the dye bleaching and silver bleaching steps by utilizing a one bath solution having a pH of below 1.5 which comprises the following components:

a. at least one compound which forms a salt or a complex with silver selected from the group consisting of water soluble organic halides, water soluble inorganic halides, thiourea, thiourea derivatives, mercapto compounds, alkali metal salts of sulfur, alkaline earth metal salts of sulfur, urea, cystein, guanidine, aminoguanidine, cyanides and thiocyanides in an amount of from about 5 to about 150g/liter;

b. at least one acid selected from sulfamic acid, aliphatic and aromatic sulfonic acids, aliphatic and aromatic sulfinic acids, phosphoric acid and sulfuric acid in an amount of from about 10 to about 120 g/liter, and c. at least one organic acid having at least one carboxyl group in the molecule in an amount from about 2 to about 60 g/liter and d. at least one ferric salt in an amount of from about 2 to about 60 g/liter, or a complex of said organic acid c) and said ferric salt d) in an amount of from about 4 to about 120 g/liter instead of said organic acid c) and said ferric salt d) in separate form.

2. The process of claim 1 wherein said aliphatic or aromatic sulfonic acid comprises 1 or 2 sulfonic acid groups linked to a lower alkyl group having 1 to 5 carbon atoms or a phenyl group which is either unsubstituted or substituted by one or two lower alkyl groups having 1–5 carbon atoms and/or amino groups; said aliphatic or aromatic sulfinic acid comprises 1 or 2 sulfinic acid groups linked to a lower alkyl group having 1–5 carbon atoms or a to a phenyl group which is either unsubstituted or substituted by one or two lower alkyl groups having 1–5 carbon atoms and/or amino groups.

3. The process of claim 1 wherein said organic acid having at least one carboxylic acid group in the molecule thereof is an aliphatic or aromatic carboxylic acid or an aminopolycarboxylic acid.

4. The process of claim 1 wherein said aliphatic carboxylic acid is formic acid or straight or branched chain alkanes or alkenes having 1–18 carbon atoms substituted by one or more carboxyl groups and wherein said aromatic carboxylic acid is one wherein one or more carboxyl groups are linked to a benzene ring or an naphthylene ring, and wherein said aminopolycarboxylic acid has 1 to 3 amino groups and 2 to 8 carboxylic acid groups and a total of 1–15 carbon atoms, exclusive of the carbon atoms in the carboxylic acid group(s).

5. The process of claim 1 wherein said ferric salt is selected from the group ferric chloride, ferric nitrate, ferric citrate, ferric acetate, ferric oxalate, ferric sulfate, ferric bromide, ferric bichromate, ferric formate, ferric naphthenate and ferric phosphate.

6. The process of claim 1 wherein the amount of component a) is 10 to 80 g/liter.

7. The process of claim 1, wherein said process includes the steps of i) imagewise exposing a light-sensitive material, prior to exposing, comprising a support having thereon a silver halide emulsion containing a bleachable dye to light, ii) developing said material by black-and-white development, iii) bleaching using the said one bath solution, and iv) fixing said material.

8. The process of claim 7, further including a fixing step between steps ii) and iii).

9. The process of claim 1, wherein the amount of component a) is about 10 to about 120 g/liter.

10. The process of claim 1, wherein the dye bleaching and silver bleaching step utilizing said solution is conducted at 20° to 40° C for about 2 to about 10 minutes.

11. The process of claim 1, wherein for component a), said thiourea derivatives are selected from the group consisting of those represented by the following formula (I)

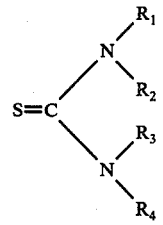

(I)

wherein $R_1$, $R_2$, $R_3$ and $R_4$ represent a hydrogen, an aliphatic group, an aryl group, an acyl group or an amino group.

12. The process of claim 1, wherein said component a) is selected from the group consisting of potassium iodide, sodium iodide, potassium bromide, sodium bromide, monoiodoacetic acid, thiourea, 1,3-dimethylthiourea, ethylenethiourea or tetramethylthiourea.

* * * * *